United States Patent [19]

Otsubo et al.

[11] 4,125,096

[45] Nov. 14, 1978

[54] IGNITION TIMING CONTROL SYSTEM

[75] Inventors: Kizuku Otsubo, Kokubunji; Akira Murasaki, Musashino; Takehiko Kita, Tachikawa, all of Japan

[73] Assignee: Nissan Motor Company, Limited, Japan

[21] Appl. No.: 694,817

[22] Filed: Jun. 10, 1976

[30] Foreign Application Priority Data

Jun. 11, 1975 [JP] Japan ..... 50-79671[U]

[51] Int. Cl.[2] ..... F02D 5/02

[52] U.S. Cl. ..... 123/117 A

[58] Field of Search ..... 123/117 A, 117 R, 146.5 A

[56] References Cited

U.S. PATENT DOCUMENTS

| | | | |
|---|---|---|---|
| 2,087,339 | 7/1937 | Arthur | 123/117 A |
| 2,107,266 | 2/1938 | Arthur | 123/117 A |
| 2,229,821 | 1/1941 | Seymour | 123/117 A |
| 3,272,191 | 9/1966 | Walker | 123/117 A |
| 3,712,279 | 1/1973 | Vartanian | 123/117 A |
| 3,895,616 | 7/1975 | Steinke | 123/117 A |
| 3,998,192 | 12/1976 | Ota | 123/117 A |

FOREIGN PATENT DOCUMENTS

| | | | |
|---|---|---|---|
| 2,458,458 | 6/1975 | Fed. Rep. of Germany | 123/117 A |

*Primary Examiner*—Charles J. Myhre
*Assistant Examiner*—Tony M. Argenbright

[57] ABSTRACT

Passage means is provided to feed atmospheric air into the vacuum chamber of a vacuum actuator of a breaker plate and a control valve is provided to control the amount of atmospheric air fed into the vacuum chamber to make the vacuum in the vacuum chamber equal to the intake manifold vacuum during engine operation below a predetermined speed and above a predetermined load and to reduce the vacuum in the vacuum chamber to a predetermined level lower than the intake manifold vacuum during engine operation above the predetermined speed and below the predetermined load so that the ignition timing of the engine is adequately retarded during running of the engine at low load and at low speed and medium load and the engine ignition timing is not retarded or is slightly retarded during running of the engine at high load and at high speed and medium load.

6 Claims, 2 Drawing Figures

IGNITION TIMING CONTROL SYSTEM

Figure 1:
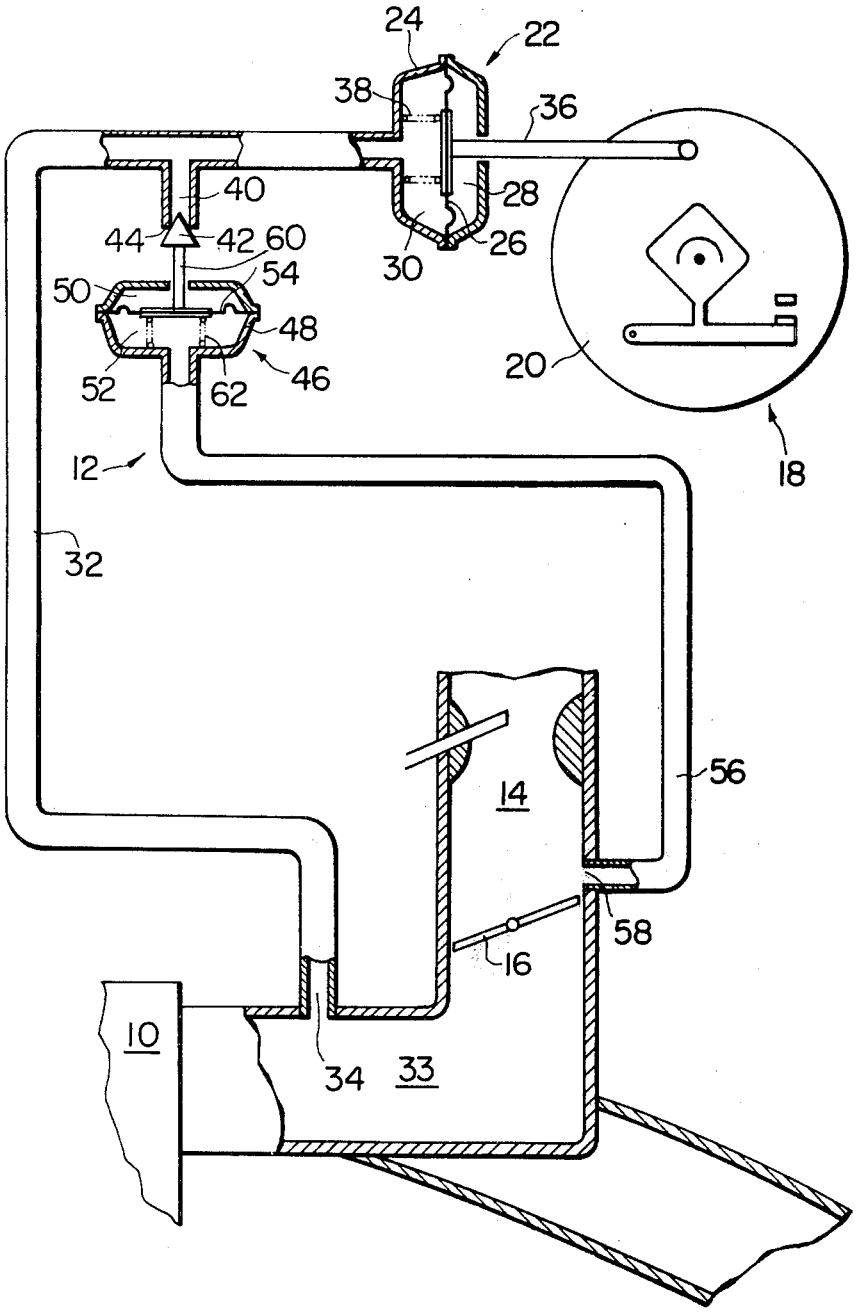

The present invention relates generally to an improvement in an ignition timing control device for an internal combustion engine and particularly to an engine ignition timing control system which is improved to prevent the ignition timing from being retarded during a medium load and high speed operation of the engine and to suitably retard the ignition timing during a low load and high speed operation of the engine by providing a control valve to feed atmospheric air into a vacuum chamber of a vacuum actuator of the breaker plate and to adjust the level of the vacuum in the vacuum chamber in accordance with the intake manifold vacuum and the degree of opening of the throttle valve.

As is well known in the art, internal combustion engines are provided in their exhaust systems with an exhaust gas purifying device such as a thermal reactor or catalytic converter for burning or oxidizing burnable components such as hydrocarbons (HC) and carbon monoxide (CO) contained in engine exhaust gases into water ($H_2O$) and carbon dioxides ($CH_2$). It is necessary for having such an exhaust gas treating device satisfactorily or efficiently purify engine exhaust gases to maintain the temperature of the engine exhaust gases and the contents of burnable components therein at high levels. When a thermal reactor is employed as an exhaust gas treating device and when a lean air-fuel mixture is employed for reducing the production of nitrogen oxides ($NO_x$) by combustion of an air-fuel mixture in an engine combustion chamber and which produces exhaust gases containing relatively small quantities of burnable components as, for example, torch ignition type internal combustion engines, it is especially important to make the temperature of the engine exhaust gases high.

As an expedient for accomplishing such a purpose, it is practised to retard the ignition timing of the engine. However, although to retard the engine ignition timing increases the temperature of engine exhaust gases, on the other hand it causes reduction in the efficiency of the engine to reduce the power of the engine and to increase the fuel consumption. As a solution to such a problem, there has been proposed an ignition timing control device which is adapted to greatly retard the engine ignition timing to increase the temperature of engine exhaust gases during an engine low load operating condition in which the power of the engine is not so much required and the temperature of engine exhaust gases is relatively low and not to retard the engine ignition timing during an engine high load operating condition in which a high power of the engine is required and the temperature of engine exhaust gases is relatively high.

Such an ignition timing control device includes an ignition distributor incorporating therein a centrifugal advance mechanism for providing an ignition timing advance optimum for an engine full load performance, and a vacuum actuator having a flexible diaphragm which is operatively connected to the breaker plate of the ignition distributor to rotate the breaker plate in opposite directions and is formed on one side thereof with a vacuum chamber fed thereinto with the intake manifold vacuum through passage means. The vacuum actuator is operable in accordance with the intake manifold vacuum to rotate the breaker plate to greatly retard the ignition timing when the engine is running under a low load condition in which the intake manifold vacuum is high and not to retard the ignition timing when the engine is running under a high load condition in which the intake manifold vacuum is low to thereby meet two opposed requirements of maintaining the temperature of engine exhaust gases and the power of the engine at high levels.

However, the conventional ignition timing control device has had a drawback that since the ignition timing is retarded in accordance with the intake manifold vacuum independently of the speed of the engine, the ignition timing is retarded even when the engine is under a medium load and high speed running condition in which it is necessary to reduce the fuel consumption and to prevent the power of the engine from being reduced, notwithstanding that it is unnecessary to retard the ignition timing since the flow of engine exhaust gases per unit time is increased to raise the temperature of engine exhaust gases when the engine is running at high speeds.

As an expedient to solve such a problem, there has been proposed an ignition timing control device which is adapted to stop retarding the ignition timing by sensing the speed of the engine or the degree of opening of the throttle valve exceeding a predetermined value and operating a solenoid valve to stop supply of the intake manifold vacuum into the vacuum chamber of the vacuum actuator and to communicate the vacuum chamber with the atmosphere. However, the conventional ignition timing control device has had drawbacks that it requires a sensor for sensing the speed of the engine or the degree of opening of the throttle valve, the solenoid valve, an electric control circuit including a switch for controlling the solenoid valve, etc. to increase the number of the parts. This causes a decrease in the reliability and an increase in the production cost. Furthermore, when the vacuum in the vacuum chamber is switched over into the atmospheric pressure or vice versa, a shock is produced to degrade the driveability or operational performance of the engine, in addition when an engine speed sensor is employed for switching over the vacuum in the vacuum chamber into the atmospheric pressure, the ignition timing is not retarded even when the engine is running at a high speed and low load condition in which the temperature of engine exhaust gases is relatively low. This causes a decrease in the temperature of the engine exhaust gases to make it impossible for the exhaust gas treating device to satisfactorily purify the engine exhaust gases.

It is, therefore, an object of the invention to provide an ignition timing control system which is improved to prevent the ignition timing from being retarded during a medium load and high speed operation of the engine and to moderately retard the ignition timing during a low load and high speed operation of the engine by employing a control valve to feed atmospheric air into the vacuum chamber of the vacuum actuator and to adjust the level of the vacuum in the vacuum chamber in accordance with the intake manifold vacuum and the degree of opening of the throttle valve so that two opposed requirements of maintaining the temperature of engine exhaust gases at a satisfactory level and of increasing the engine power and the fuel economy are accurately satisfied without complicating the construction of the system.

Figure 2:
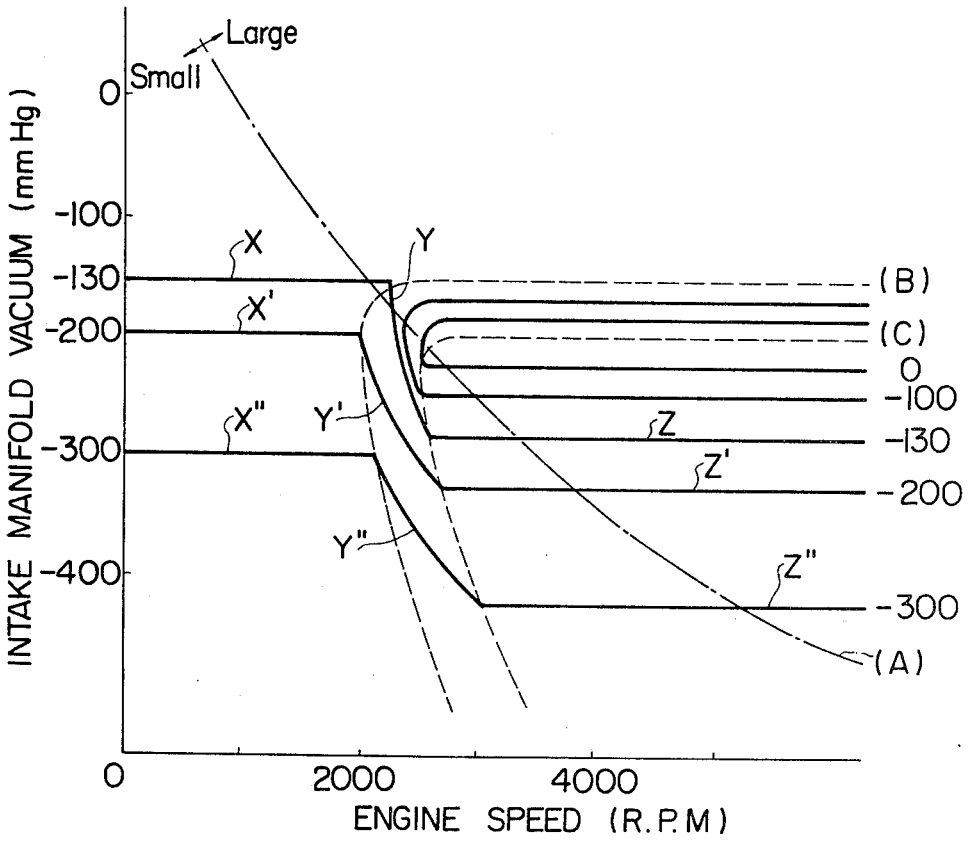

This and other objects and advantages of the invention will become more apparent from the following detailed description taken in connection with the accompanying drawings in which:

FIG. 1 is a schematic partially cross sectional view of a preferred embodiment of an ignition timing control system according to the invention; and FIG. 2 is a graphic representation of the characteristics of the vacuum in the respective vacuum chambers of two vacuum servos forming part of the ignition timing control system shown in FIG. 1.

Referring to FIG. 1 of the drawings, there is shown an internal combustion engine 10 and an ignition timing control system 12 according to the invention which is combined with the engine 10. The engine 10 is shown to include an intake passageway 14 providing communication between an intake port (not shown) of the engine 10 and the atmosphere, a throttle valve 16 rotatably mounted in the intake passageway 14, and an ignition distributor 18 for controlling the ignition timing of the engine 10 and having a centrifugal advance mechanism (not shown) and a breaker plate 20 rotatable in opposite directions to retard and advance the ignition timing of the engine 10.

The ignition timing control system 12 comprises a vacuum servo or actuator 22 which is a diaphragm assembly including a housing 24, and a flexible diaphragm 26 dividing the interior of the housing 24 into first and second chambers 28 and 30. The first chamber 28 communicates with the atmosphere, while the second chamber 30 communicates with passage means 32 such as a conduit which opens into the intake passageway 14 at a section 33 downstream of the throttle valve 16 through an inlet port 34 so that the second chamber 30 is fed with the vacuum in the intake passageway 14 at the section 33 which is referred to as the intake passageway vacuum or intake manifold vacuum hereinafter. The diaphragm 26 is operatively connected to the breaker plate 20 through an actuating rod 36 so that the vacuum servo 22 is operable to retard the ignition timing of the engine 10 in accordance with the vacuum in the vacuum chamber 30. The chambers 28 and 30 are located with respect to the breaker plate 20 in this embodiment in such a manner that the ignition timing of the engine 10 is retarded as the breaker plate 20 is rotated counterclockwise in the drawing. Biasing means such as a spring 38 is provided to urge the diaphragm 26 in a direction opposed by the action of the atmospheric pressure in the first chamber 28 and in which the ignition timing of the engine 10 is advanced.

The ignition timing control system 12 also comprises passage or conduit means 40 which communicates at one end with the passage means 32 and at the other end with the atmosphere to feed atmospheric air into the vacuum chamber 30. The passage means 40 may be connected to the vacuum chamber 30 to directly communicate with or open into same. A control valve 42 is provided to be associated with the passage means 40 and to control the amount of air fed into the vacuum chamber 30 to adjust the level of the vacuum therein in accordance with the degree of opening of the throttle valve 16 and the speed of the engine 10. The control valve 42 is located at the inlet end 44 of the passage means 40 in this embodiment and includes a vacuum servo or actuator 46 including a housing 48 having first and second chambers 50 and 52 therein, and a flexible diaphragm 54 separating the chambers 50 and 52 from each other. The first chamber 50 communicates with the atmosphere, while the second chamber 52 communicates with passage or conduit means 56 which opens into the intake passageway 14 upstream of the throttle valve 16 in its substantially fully closed position through an inlet port 58 to feed the vacuum in the intake passageway 14 at the port 58 into the vacuum chamber 52. Particularly, the passage means 56 communicates with the intake passageway 14 so that the position of the inlet port 58 varies from upstream of the throttle valve 16 to downstream thereof as the degree of opening of the throttle valve 16 is increased. Furthermore, by properly selecting the position of the inlet port 58, the vacuum in the vacuum chamber 52, when the degree of opening of the throttle valve 16 is above a predetermined value, is equal to the intake passageway vacuum and, when the degree of opening of the throttle valve 16 is below the predetermined value, becomes less than the intake passageway vacuum. The diaphragm 54 is operatively connected to the control valve 42 through an actuating rod 60 so that the vacuum servo 46 is operable to increase and reduce the degree of opening of the control valve 42 in accordance with an increase and a decrease in the vacuum in the vacuum chamber 52. A spring 62 is provided to urge the diaphragm 54 in a direction opposed by the action of the atmospheric pressure in the first chamber 50 and in which the degree of opening of the control valve 42 is reduced.

The ignition timing control system 12 thus far described is operated as follows:

Referring to FIG. 2 of the drawings, there is shown the characteristics chart of the vacuum in the vacuum chambers 30 and 52 with respect to the degree of opening of the throttle valve 16, the intake manifold vacuum and the speed of the engine 10. In FIG. 2, the dashes and dotted line A indicates the relationship between the intake manifold vacuum and the speed of the engine 10 at the time when the degree of opening of the throttle valve 16 is the above-mentioned predetermined value. The degree of opening of the throttle valve 16, as the position with respect to the line A is away therefrom upwardly and obliquely, increases and as the position with respect to the line A is away therefrom downwardly and obliquely, decreases. The dotted lines B and C indicate the characteritics curves of the vacuum in the vacuum chamber 52 of the vacuum servo 46 obtained by properly selecting the position of the inlet port 58 as mentioned hereinbefore and illustrate two examples in which the vacuum in the vacuum chamber 52 is −130 mmHg and −200 mmHg, respectively in the drawing. As shown in FIG. 2, the vacuum in the vacuum chamber 52, when the degree of opening of the throttle valve 16 is above the predetermined value, is equal to the intake manifold vacuum and, when the degree of opening of the throttle valve 16 is below the predetermined value, is reduced lower than the intake manifold vacuum and is at various predetermined levels which are determined by a combination of the degree of opening of the throttle valve 16 and the speed of the engine 10 when the intake manifold vacuum increases. The condition in which the vacuum in the vacuum chamber 52 is a predetermined value with increases in the intake manifold vacuum or decreases in the degree of opening of the throttle valve 16 takes place or is obtained with the speed of the engine 10 varying or increasing relatively a little and in a predetermined speed range of, for example, 2,000 to 2,800 r.p.m. or 2,500 to 3,500 r.p.m. as shown by the lines B and C. Accordingly, when the operational characteristics of the control valve 42 is set in such a way that the control valve 42, when the vacuum in the vacuum chamber 52 is, for example, −130 mmHg, starts to be opened by the vacuum servo 46 and, when the vacuum in the vacuum chamber 52 is, for example, −200 mmHg, is fully opened by the vacuum servo 46, the control valve 42 is fully closed when the vacuum in the vacuum chamber 52 is below −130 mmHg, viz., is a value within a zone left and above of the line B, the control valve 42 is partially opened when the vacuum in the vacuum chamber 52 is between −130 and −200 mmHg, that is, a value within a zone between the lines B and C, and the control valve 42 is fully opened when the vacuum in the vacuum chamber 52 is above −200 mmHg, viz., is a value within a zone right and below of the line C. As a result, when the control valve 42 is fully closed, that is, the speed of the engine 10 is within a low speed range, the vacuum in the vacuum chamber 30 of the vacuum servo 22 is equal to the intake manifold vacuum and when the control valve 42 is partially or fully opened, that is, the speed of the engine 10 is within medium and high speed ranges, the vacuum in the vacuum chamber 30 is reduced lower than the intake manifold vacuum. Accordingly, the characteristics of the vacuum in the vacuum chamber 30 is as the solid lines X, Y, Z; X′, Y′, Z′; and X″, Y″, Z″ shown in FIG. 2 which illustrate three examples in which the vacuum in the vacuum chamber 30 is −130, −200 and −300 mmHg, respectively. In this instance, the solid lines X, X′, X″ indicate when the control valve 42 is closed, while the solid lines Y, Y′, Y″ and Z, Z′, Z″ indicate when the control valve 42 is partially and fully opened, respectively.

Thus, when the operational characteristics of the vacuum servo 22 is set in such a manner that the vacuum servo 22 begins to retard the ignition timing of the engine 10 when the vacuum in the vacuum chamber 30 is, for example, −130 mmHg, the vacuum actuator 22 is prevented from retarding the ignition timing of the engine 10 when the vacuum in the vacuum chamber 30 is below −130 mmHg, viz., is a value within a zone above the line X, Y, Z of −130 mmHg, and the vacuum actuator 22 retards the ignition timing of the engine 10 in accordance with the vacuum in the vacuum chamber 30 when the vacuum in the vacuum chamber 30 is above −130 mmHg, viz., is a value within a zone below the line X, Y, Z of −130 mmHg. As a result, the ignition timing of the engine 10 is not retarded or is slightly retarded during an engine high speed and high and medium load operation. Thus, the temperature of the engine exhaust gases is maintained at high or desirable levels without causing a decrease in the engine power and an increase in the fuel consumption.

Various retardation characteristics of the ignition timing are obtained by adequately selecting the position of the inlet port 58 of the passage means 56, and the operational characteirstics of the vacuum actuator 22 and of the control valve 42.

It will be appreciated that the invention provides an improved ignition timing control system comprising passage means which feeds atmospheric air into a vacuum chamber of a vacuum actuator of an ignition distributor breaker plate and a control valve which is operated to close the passage means to inhibit atmospheric air to be fed into the vacuum chamber to make the vacuum therein equal to the intake manifold vacuum during operation of the engine below a predetermined speed and above a predetermined load and to open the passage means to allow atmospheric air to be fed into the vacuum chamber to reduce the vacuum therein to a predetermined level lower than the intake manifold vacuum during operation of the engine above the predetermined speed and below the predetermined load so that the ignition timing of the engine is properly retarded to maintain the temperature of engine exhaust gases above a predetermined level to have an exhaust gas treating device satisfactorily purify the engine exhaust gases when the engine is running at low load and at low speed and medium load and the engine ignition timing is not retarded or is slightly retarded to prevent the engine power from being reduced and the fuel consumption from being increased when the engine is running at high load and at high speed and medium load.

It will be appreciated that the invention provides an improved ignition timing control system in which the vacuum in a vacuum chamber of a vacuum actuator of a breaker plate is adjusted by a control valve continuously operated from its fully closed position to its full open position and vice versa by a vacuum servo so that the vacuum in the vacuum chamber is prevented from being abruptly varied and accordingly, the engine ignition timing is prevented from being suddenly varied to prevent the occurrence of a shock which degrades the driveability of the engine.

What is claimed is:

1. An ignition timing control system in combination with an internal combustion engine including a breaker plate and an intake passageway having a throttle valve rotatably mounted therein, said system comprising a vacuum actuator means for operating said breaker plate and having a first vacuum chamber in vacuum communication with said intake passageway downstream of said throttle valve in its substantially fully closed position for receiving an engine suction vacuum and operable to retard the ignition timing of said engine in accordance with the vacuum in said first vacuum chamber, passage means communicating with the atmosphere and with said first vacuum chamber to feed atmospheric air thereinto, a control valve means associated with said passage means, a vacuum servo operatively connected to said control valve means and having a second vacuum chamber which communicates with said intake passageway at a position upstream of said throttle valve in its substantially fully closed position and downstream of said throttle valve opened a predetermined amount, said control valve means being operated by the vacuum in said second vacuum chamber to control the amount of atmospheric air fed into said first vacuum chamber to adjust the level of the vacuum therein to cause said vacuum actuator to retard the ignition timing of said engine in accordance with said intake passageway vacuum and the degree of the opening of said throttle valve.

2. An ignition timing control system as claimed in claim 1, in which said second vacuum chamber communicates with said intake passageway at a position at which, when the degree of opening of said throttle valve is above a predetermined value, the vacuum in said second vacuum chamber is equal to said intake passageway vacuum and, when the degree of opening of said throttle valve is below said predetermined value, the vacuum in said vacuum chamber depends on said intake passageway vacuum and the degree of the opening of said throttle valve and is designed so that the speed of said enging increases relatively little and said intake passageway vacuum increases to the maximum, in which said control valve means is designed so that when the vacuum in said second vacuum chamber is below a first predetermined value, said control valve means closes said passage means to inhibit atmospheric air from entering said first vacuum chamber to cause said vacuum actuator means to retard the ignition timing of said engine in accordance with said intake passageway vacuum and, when the vacuum in said second vacuum chamber is above said first predetermined value, said control valve means opens said passage means to allow atmospheric air to enter said first vacuum chamber to a predetermined level lower than said intake passageway vacuum and said vacuum actuator actuator is constructed so that when the vacuum in said first vacuum chamber is at said first predetermined value, said vacuum actuator means causes the breaker plate to retard the ignition timing of said engine in a predetermined amount and when the vacuum in said first vacuum chamber is below and above said first predetermined value, said vacuum actuator means causes the breaker plate to retard the ignition timing of said engine below and above said predetermined amount, respectively.

3. An ignition timing control system as claimed in claim 2, in which said control valve means is constructed so that, when the vacuum in said second vacuum chamber is said first predetermined value, said control valve means begins to open and, when the vacuum in said second vacuum chamber is between said first predetermined value and a second predetermined value higher than said first predetermined value, said control valve means is partially opened and, when the vacuum in said second vacuum chamber is above said second predetermined value said control valve means is fully opened.

4. An ignition timing control system in combination with an internal combustion engine including a breaker plate and an intake passageway having a throttle valve rotatably mounted therein, said system comprising a first actuator including a first vacuum chamber communicating with said intake passageway downstream of said throttle valve in its substantially fully closed position for receiving an engine suction vacuum, said first actuator being operatively connected to said breaker plate so that said breaker plate is operated to retard the ignition timing of said engine in accordance with the vacuum in said first vacuum chamber, passage means communicating with the atmosphere and with said first vacuum chamber for feeding atmospheric air thereinto, a control valve, a second actuator including a second vacuum chamber communicating with said intake passageway at a position upstream of said throttle valve in its substantially fully closed position and downstream of said throttle valve opened a certain amount, said second actuator being operatively connected to said control valve so that said control valve is operated by the vacuum in said second vacuum chamber to control the amount of atmospheric air admitted into said first vacuum chamber to adjust the level of the vacuum therein to cause said first actuator to retard the ignition timing of said engine in accordance with the vacuum in said first vacuum chamber and the degree of opening of said throttle valve.

5. An ignition timing control system in combination with an internal combustion engine including a breaker plate and an intake passageway having a throttle valve rotatably mounted therein, said system comprising a first actuator including a first vacuum chamber, and first passage means providing communication between said first vacuum chamber and said intake passageway downstream of said throttle valve in its substantially fully closed position for admitting an engine suction vacuum into said first vacuum chamber, said first actuator being operatively connected to said breaker plate so that said breaker plate is operated to retard the ignition timing of said engine in accordance with the vacuum in said first vacuum chamber, second passage means providing communication between said first passage means and the atmosphere for admitting atmospheric air into said first vacuum chamber, a control valve, a second actuator including a second vacuum chamber, and third passage means providing communication between said second vacuum chamber and said intake passageway at a position upstream of the throttle valve in its substantially fully closed position and downstream of said throttle valve opened a certain amount, said second actuator being operatively connected to said control valve so that said control valve is operated by the vacuum in said second vacuum chamber to control the amount of atmospheric air admitted into said first vacuum chamber to adjust the level of the vacuum therein to cause said first actuator to retard the ignition timing of said engine in accordance with the vacuum in said first vacuum chamber and the degree of opening of said throttle valve.

6. An ignition timing control system in combination with an internal combustion engine including a breaker plate and an intake passageway having a throttle valve rotatably mounted therein, said system comprising a first actuator including a first vacuum chamber, a first flexible diaphragm having at a side thereof said first vacuum chamber, and first passage means providing communication between said first vacuum chamber and said intake passageway doenstream of said throttle valve in its substantially fully closed position for admitting an engine suction vacuum into said first vaccum chamber, said first diaphragm being operatively connected to said breaker plate so that said breaker plate is operated to retard the ignition timing of said engine in accordance with the vacuum in said first vacuum chamber, second passage means providing communication between said first passage means and the atmosphere for admitting atmospheric air into said first vacuum chamber, a control valve, a second actuator including a second vacuum chamber, a second flexible diaphragm having at a side thereof said second vacuum chamber, and third passage means providing communication between said second vacuum chamber and said intake passageway at a position upstream of said throttle valve in its substantially fully closed position and downstream of said throttle valve opened a certain amount, said second diaphragm being operatively connected to said control valve so that said control valve is operated by the vacuum in said second vacuum chamber to control the amount of atmospheric air admitted into said first vacuum chamber to adjust the level of the vacuum therein to cause said first actuator to retard the ignition timing of said engine in accordance with the vacuum in said first vacuum chamber and the degree of opening of said throttle valve.

* * * * *